US005634607A

United States Patent [19]

Poloni

[11] Patent Number: 5,634,607

[45] Date of Patent: Jun. 3, 1997

[54] METHOD TO EXTRACT AND DEPOSIT COILS IN A ROLLING LINE AND DEVICE TO PERFORM THE METHOD

[75] Inventor: Alfredo Poloni, Redipuglia, Italy

[73] Assignee: Danieli & C. Officine Meccaniche SpA, Buttrio, Italy

[21] Appl. No.: 396,785

[22] Filed: Mar. 1, 1995

[30] Foreign Application Priority Data

Mar. 23, 1994 [IT] Italy ..... UD94A0044

[51] Int. Cl.[6] ..... B21C 47/24; B21F 17/00; B65G 15/12

[52] U.S. Cl. ..... 242/363; 100/152; 198/626.5; 140/2

[58] Field of Search ..... 242/360, 361.3, 242/361.4, 361.5, 362.2, 362.3, 363; 140/2; 100/152; 198/626.5

[56] References Cited

U.S. PATENT DOCUMENTS

| | | | |
|---|---|---|---|
| 1,601,415 | 9/1926 | Rusbatch | 242/361.5 |
| 4,114,531 | 9/1978 | Plaut | 100/152 X |
| 4,154,269 | 5/1979 | Masahiko et al. | 140/2 |
| 4,168,993 | 9/1979 | Wilson et al. | 148/12 B |
| 5,284,546 | 2/1994 | Tilby | 100/152 X |

FOREIGN PATENT DOCUMENTS

| | | |
|---|---|---|
| 1291716 | 4/1969 | Denmark . |
| 346666 | 5/1989 | European Pat. Off. . |
| 2010428 | 6/1969 | France . |
| 1056915 | 10/1964 | United Kingdom . |

OTHER PUBLICATIONS

Patent Abstracts of Japan vol. 9, No. 241 Sep. 27, 1985 & JP A 60 100633 (Kobe Seikosho KK) 4 Jun. 1985 –Abstract.

*Primary Examiner*—John Q. Nguyen
*Attorney, Agent, or Firm*—Antonelli, Terry, Stout & Kraus, LLP

[57] ABSTRACT

Method and device to extract and deposit coils leaving a coiling machine (11), the coiling machine (11) forming the coils (22) according to an inclined axis and depositing the coils (22) on a a removal conveyor belt (12) positioned with its axis substantially horizontal, a coil-retaining assembly (13) in its first working position closing at least partly the outlet of the coils (22) from the coiling machine (11) for a period enough to permit the formation and accumulation of a desired number of leading-end coils within the coiling machine (11) and then being opened in its second release position, in which it frees the outlet of the coils (22) from the coiling machine (11) and enables the number of leading-end coils to fall simultaneously onto the removal conveyor belt (12), this simultaneous fall causing the flattening of the leading-end coils on the removal conveyor belt (12) owing to the weight of that number of leading-end coils.

6 Claims, 2 Drawing Sheets

METHOD TO EXTRACT AND DEPOSIT COILS IN A ROLLING LINE AND DEVICE TO PERFORM THE METHOD

BACKGROUND OF THE INVENTION

This invention concerns a method to extract and deposit coils in a rolling line and concerns also the device that performs the method.

The invention is applied advantageously to the field of iron metallurgy and, in particular, downstream of a coiling machine installed in line with a plant carrying out rolling of rod, the plant including at least one step of in-line thermal treatment of the rolled stock.

Coiling machines installed at the outlet of a rolling line producing rod, which is thereafter coiled on reels, are known in the state of the art.

In the plants of the state of the art the hot rod coming from the rolling line is coiled in spirals in a coiling machine; the coils leaving the coiling machine fall regularly and naturally onto a downstream removal conveyor belt.

The coils are arranged partly superimposed on each other and lying on the substantially horizontal surface of the removal conveyor belt, which delivers the coils to a winding means.

In normal plants for winding in the hot state, the coils forming the leading and trailing-ends fall upright onto the belt and then arrange themselves parallel to the removal conveyor belt.

Where the products are treated thermally in line with a surface hardening treatment, which causes the rolled stock to have its leading and trailing ends cold or where other particular thermal treatments are carried out which bring the strength of the rod up to values of about 400 N/mm$^2$ or even up to 700 N/mm$^2$, the process of forming the coils in the coiling machine entails a series of problems.

In particular, the leading coils leaving the coil-forming head of the coiling machine do not drop along the conveyor belt but have a tendency to stay upright at a right angle to the removal conveyor belt and to proceed along a given segment of the belt like a spring having a horizontal axis.

These leading-end coils tend to keep the other coils too in that position and cause a great obstruction in the end and make it impossible to carry out the winding.

The trailing-end coils behave in a like manner and also stay upright at a right angle to the conveyor belt, thus making impossible the next step of collecting the coils.

In plants which carry out in-line thermal treatment of the rolled products, in order to make possible the correct falling of the leading and trailing-end coils on the removal conveyor belt, the solution has been adopted of making these leading and trailing-end coils arrive in the hot state at the coil-forming means, whereas all the other intermediate coils arrive there cold.

This makes necessary the disposal and elimination of the leading and trailing-end coils, thus entailing a great waste of material which may involve losses even of some tons of material.

Moreover, with the plants of the state of the art it is impossible to wind rods having a high strength of about 600 N/mm$^2$, for instance.

Patent GB-A-1,056,915 discloses a device to wind hot rolled products which is positioned at the exit of the rolling line; this device includes a coil-forming assembly associated downstream with means of a rotary chain type which convey coils.

These means to convey coils are suitable to engage one coil at a time and make it pass into a cooling chamber, thereafter positioning it on finger means positioned circumferentially in cooperation with the upper end of a collection block on which the coils are collected.

These finger means have the task of cooperating with the coil-collection block in the winding step and are positioned in a contact position where they retain the coils when the collection block has to be permitted to be lowered and removed from the device when the winding process has ended, the fingers remaining there for the whole time necessary to re-position a new coil-collection block.

This winding device works with hot products which do not cause the problems linked to the strength of the leading and trailing-end coils as mentioned above.

Moreover the finger means are not positioned in cooperation with the coil-forming assembly and do not act on the coils just formed but cooperate with the coil-collection block after the coils have passed through the whole cooling chamber and during the step in which the coils are laid on the coil-collection block.

U.S. Pat. No. 4,168,993 is also known and includes a coil-forming assembly that discharges the coils onto a conveyor belt, on which the coils are subjected to a cooling process by means of high-velocity water jets acting on the coils from below.

The coils subjected to the action of the jets may undergo a displacement due to the high speed and high pressure at which the water is sprayed.

This document therefore includes an open chain conveyor placed above the conveyor belt and having the task of accompanying the coils to keep them in position and to prevent any displacement thereof.

This document too works with hot products which do not suffer the above problems inasmuch as the hot coils have a natural tendency to remain deposited on the belt, and only the occurrence of an external factor may cause the displacement of the coils from their correct position on the conveyor belt.

Moreover, the open chain conveyor does not have the task of flattening coils which tend to rise again and to stay upright owing to natural causes, but has the task of retaining the correct position of the coils on the conveyor belt when the coils are displaced upwards as a result of the action of the jets acting from below.

SUMMARY OF THE INVENTION

The present applicants have designed, tested and embodied this invention to overcome the shortcomings of the state of the art and to achieve further advantages.

The purpose of the invention is to provide a method and a device which enable the leading-end coils leaving the coil-forming head of a coiling machine to be deposited on the removal conveyor belt even when the products being coiled have a strength that is greater than 400 N/mm$^2$ and may even reach 700 N/mm$^2$.

By employing the device according to the invention it is thus possible to wind rod having a strength up to 700 N/mm$^2$.

The method and the device according to the invention are applied to rolled products, which before undergoing the winding process are treated thermally in line, for instance with a thermal treatment process of surface hardening of a quenching type.

The device according to the invention is also employed advantageously, although not only, in cooperation with coiling machines which form the coils according to an axis inclined to the horizontal and discharge those coils onto a removal conveyor belt having its axis substantially horizontal.

According to the invention the device comprises at least one coil-retaining assembly cooperating with the outlet of the coiling machine.

According to a variant the device according to the invention comprises also an assembly to overturn and flatten the coils on the removal conveyor belt.

The coil-retaining assembly has the task of preventing the departure, from the coiling machine, of a first group of coils consisting, for instance, of three to fifteen leading-end coils prepared by the coil-forming head, and then lets all these coils fall together onto the removal conveyor belt in such a way that these coils, owing to their own weight, subside onto the substantially horizontal plane of the removal conveyor belt and draw with them the successive coils too.

This coil-retaining assembly has a first closed working position, in which it prevents the departure of the leading coils prepared by the coil-forming head, and a second open release position, in which it does not impede the coils leaving the coiling machine, these coils thus being free to fall onto the removal conveyor belt as they are formed.

According to a variant the coil-retaining assembly can also be employed to improve the laying of the trailing-end coils on the removal conveyor belt.

To be more exact, the coil-retaining assembly is closed in its first working position when a certain number of trailing-end coils still has to leave the coiling-forming head, thus preventing the falling of that number of coils forming the trailing-end onto the conveyor belt.

These trailing-end coils are then all released together by the opening of the coil-retaining assembly in its release position, thus assisting the falling of the trailing-end coils owing to their own weight and their correct positioning and flattening on the removal conveyor belt.

In the event of special products, for instance special steels, or in the event of specific thermal treatments, the invention arranges to employ also the assembly that overturns and flattens the coils.

This coil overturning and flattening assembly has the tasks of guiding and causing the required falling of the coils leaving the outlet of the coiling machine and of placing those coils in a regular and substantially central manner on the removal conveyor belt.

This coil overturning and flattening assembly also has the task of maintaining a regular pitch between one coil and another.

Moreover the coil overturning and flattening assembly has the task of keeping the coils flattened on the conveyor belt along a certain segment of the belt and of providing them with a desired position which prevents them from possibly rising again.

To be more exact, the coil overturning and flattening assembly enables the coils to be kept flattened on the removal conveyor belt for the time needed for the tempering of the material after the sharp cooling undergone on the line upstream of the coiling machine, so as to resist the tendency of the coils, and in particular of the trailing-end coils, to stay upright owing to the rigidity of the material.

The coil overturning and flattening assembly has a first working position, in which it is positioned at the outlet of the coil-forming head and above the removal conveyor belt and cooperates with the coils passing by, and a second inactive position, in which it is distanced from the belt.

According to the invention the coil overturning and flattening assembly comprises first and second track means arranged in sequence axially to the removal conveyor belt.

The first track means are inclined in relation to the horizontal with their upstream portion raised so as to cooperate directly with the outlet from the coiling machine and to guide the coils falling onto the removal conveyor belt.

According to the invention the speed of movement of the first track means is at least slightly faster than the speed of departure of the coils from the coiling machine, the purpose being to draw the coils and thus to facilitate their overturning and successive depositing on the removal conveyor belt.

The second track means are positioned in sequence to the first track means and substantially parallel to and above the removal conveyor belt and have the task of flattening the coils and keeping them lowered on the removal conveyor belt along a certain segment so as to prevent the resilience and thermal tempering of the material from possibly lifting the coils.

According to the invention, in the event of hot rolling without any type of in-line thermal treatment, both the coil retaining assembly and the coil overturning and flattening assembly may be brought to their respective inactive positions since in such a case their working may not be required by the type of process in progress.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 4:
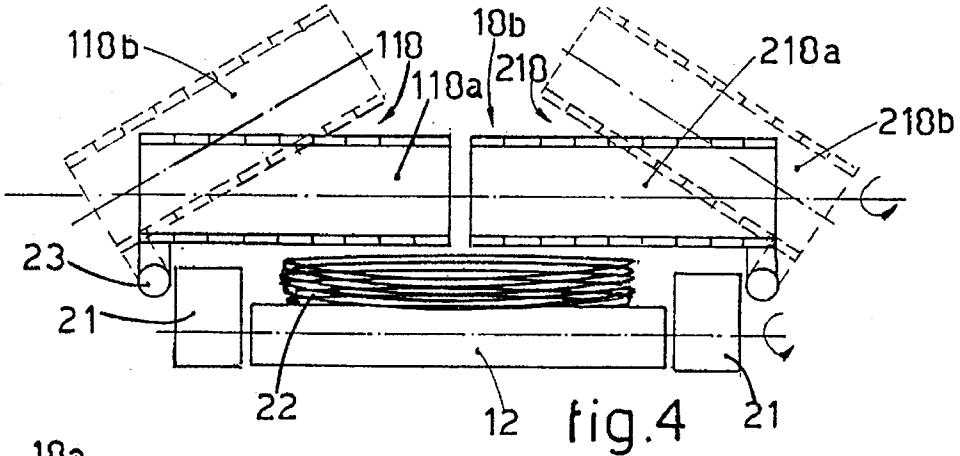
FIG. 4 shows a partly simplified view of the device of FIG. 1 according to the arrow C.

A device 10 to extract and deposit coils according to the invention is installed at the outlet of a coiling machine 11 so as to enable the coils to be laid correctly on a removal conveyor belt 12 even where the materials of the coils have a strength greater than 400 N/mm$^2$.

In this case the device 10 according to the invention comprises an assembly 13 to retain the coils and an assembly 14 to overturn and flatten the coils on the removal conveyor belt 12; the assemblies 13–14 can be included individually or in combination in the device 10 according to the invention.

The coil retaining assembly 13 and the coil overturning and flattening assembly 14 are actuated independently of each other.

In particular, it is possible to actuate only the coil-retaining assembly 13 where the material has a strength up to 400 N/mm$^2$, whereas for materials having a strength greater than 400 N/mm$^2$ it is convenient to actuate both the coil-retaining assembly 13 and the coil overturning and flattening assembly 14.

The coil-retaining assembly 13 is positioned in direct cooperation with the outlet of the coiling machine 11.

The coil retaining assembly 13 has the task of preventing momentarily the emerging, from the coiling machine 11, of a given number of leading-end coils prepared by the coil-forming head of the coiling machine 11 until a number of between 3 and 15 coils has been accumulated, and then to let them all fall at the same time onto the removal conveyor belt 12 owing to the force of their own weight and to the thrust of the successive coils being formed.

The coil retaining assembly 13 can be used advantageously also to prevent momentarily the emerging of the trailing-end coils until a number of between 3 and 15 coils has been accumulated, and then to let them all fall at the same time onto the removal conveyor belt 12.

The coil retaining assembly 13 comprises in this case two retaining blades 15 positioned circumferentially in cooperation with the outlet of the coiling machine 11 on both sides of the coiling machine 11.

The retaining blades 15 are hinged at the sides of the outlet of the coiling machine 11 and have a first working position 15*a*, in which they shut partly the outlet of the coiling machine 11, thus preventing the emerging of the coils formed within the coiling machine 11.

The retaining blades 15 have a second release position 15*b*, in which they do not obstruct the outlet of the coiling machine 11 but thus allow the accumulated coils within the coiling machine and the successive coils to fall onto the removal conveyor belt 12.

In this case the retaining blades 15 are hinged at 16 on the frame of the coiling machine 11 and are operated by cylinder/piston actuators 17.

The coil overturning and flattening assembly 14 is installed downstream of the coil retaining assembly 13 and comprises track means 18, namely first track means 18*a* and second track means 18*b* respectively which are installed in sequence.

The first track means 18*a* are inclined in relation to the horizontal with their lower part lying downstream, and their inclination can be adjusted advantageously in relation to the horizontal, and they are raised by a desired value above the removal conveyor belt 12.

The second track means 18*b* are substantially parallel to the removal conveyor belt 12 and are raised thereabove 12 by a desired value.

The first track means 18*a* have the task of acting on the upper side of each coil leaving the coiling machine 11 and flatten and overturn the coil on the removal conveyor belt 12, thus assisting the laying of the coils 22 substantially in horizontal and partly overlapping positions on the removal conveyor belt 12.

The second track means 18*b* have the task of keeping the coils 22 flattened on the removal conveyor belt 12 along a segment thereof and therefore for a given time, which depends on the period of tempering of the coils 22 after the sharp cooling which the material has undergone in-line upstream of the coiling machine 11, and these second track means 18*b* thus prevent the coils 22 from being able to stand upright and rise on the removal conveyor belt 12 owing to the tempering.

Both the first track means 18*a* and second track means 18*b* are driven independently of each other by a first motor 19*a* and second motor 19*b* respectively.

In this case the first and second track means 18*a*–18*b* cooperate respectively with tension adjustment means 20*a* and 20*b*.

The first track means 18*a* are driven advantageously at a speed higher than the speed at which the coils 22 leave the coiling machine 11, so that the first track means 18*a* assist the action of drawing the coils 22 and overturning them onto the removal conveyor belt 12.

The second track means 18*b* move advantageously at a speed equal or substantially equal to the speed of movement of the removal conveyor belt 12 and have the task of keeping the coils 22 flattened on the removal conveyor belt 12, thus preventing the coils 22 from becoming upright owing to the resilience of the material.

In an advantageous form of embodiment of the invention each of the track means 18 consists of two half-track means, each of which extends sideways by substantially a half of the width of the conveyor belt 12.

Figure 1:
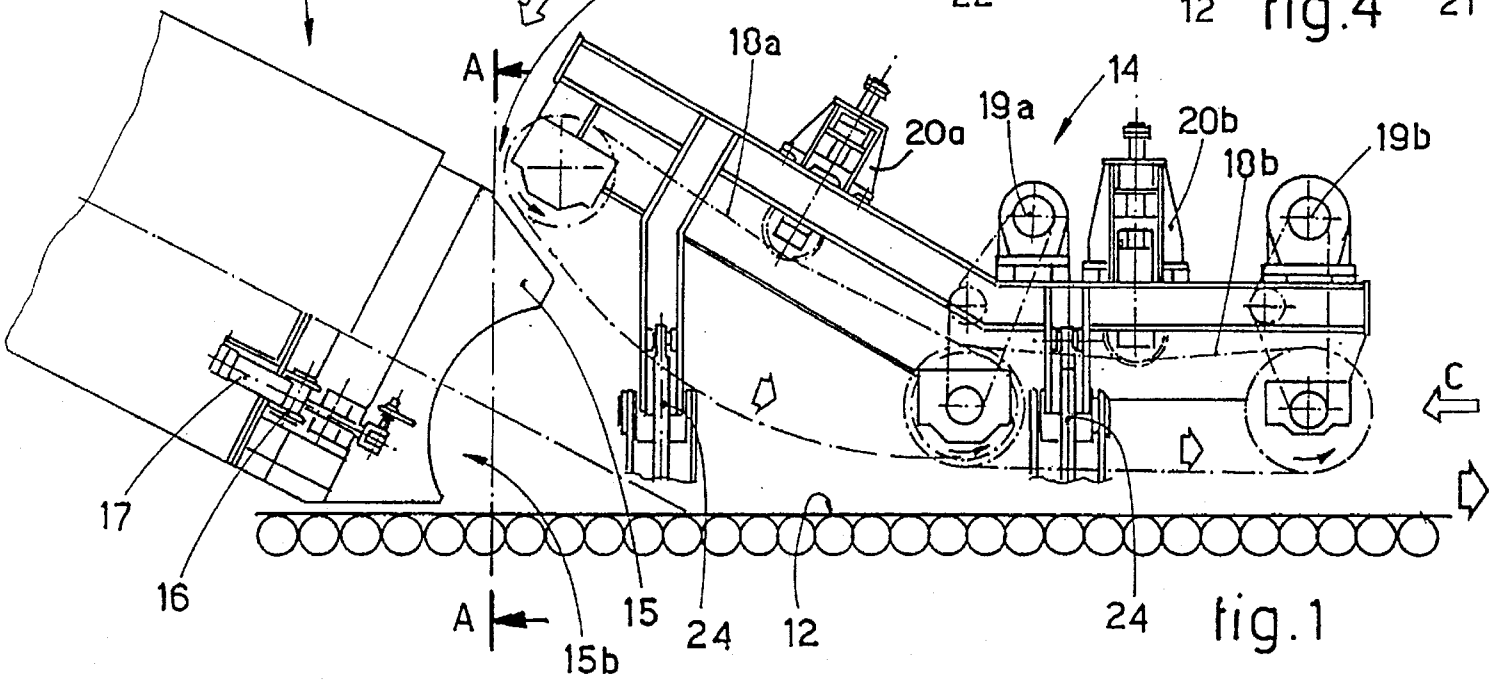
FIG. 1 is a side view of the device to extract and deposit coils according to the invention.
Figure 2:
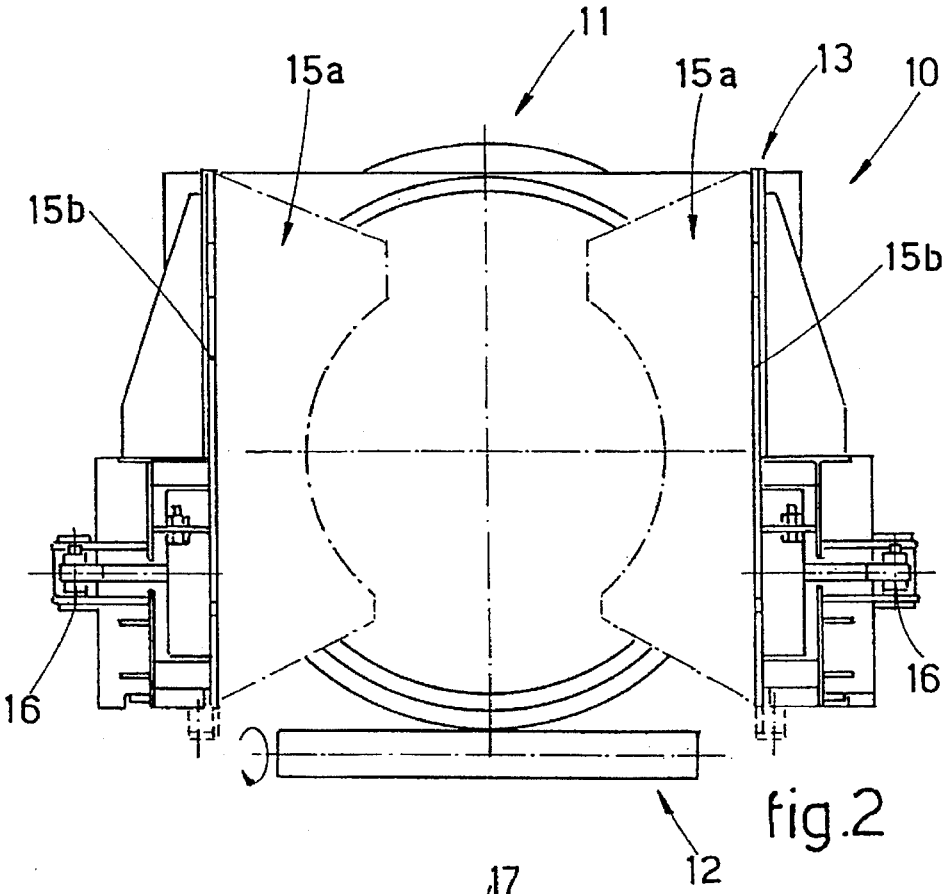
FIG. 2 is a view of a section of the device along the line A—A of FIG. 1.
Figure 3:
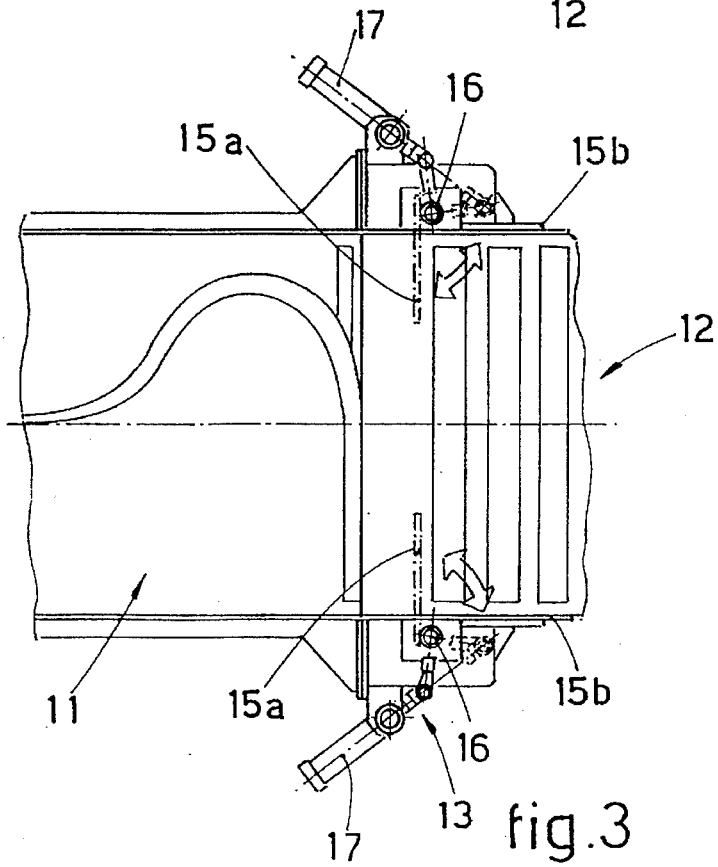
FIG. 3 is a plan view of the device according to the arrow B of FIG. 1.

FIG. 4, which shows diagrammatically the view according to the arrow C of FIG. 1, illustrates the two half-track means 118 and 218 respectively, which together form the second track means 18*b* parallel to the removal conveyor belt 12, but the equivalent situation exists also in the case of the first track means 18*a* inclined in relation to the removal conveyor belt 12.

The solution of including half-track means 118–218 makes the lifting action easier when it is desired to bring the track means 18*a*–18*b* to their relative inactive positions.

In the device 10 according to the invention the coil overturning and flattening assembly 14 has an inactive position distanced from the removal conveyor belt 12, in which position it does not contact the coils passing along the removal conveyor belt 12, for instance in the event of hot rolling or where the products have a strength less than 400 $N/mm^2$.

In this case each of the half-track means 118–218 forming together the first 18*a* and second 18*b* track means are hinged at their sides 23 associated with shoulders 21 of the removal conveyor belt 12.

These half-track means 118–218 are actuated by respective actuator means 24 (not shown in FIG. 4 for convenience of illustration but drawn in FIG. 1), which are suitable to bring the half-track means 118–218 from their respective lowered working positions 118*a*–218*a* to their respective raised inactive positions 118*b*–218*b* (shown with lines of dashes in FIG. 4) when their work is not required or necessary, as in the case of hot rolling, for instance.

These inactive positions 118*b*–218*b* of the second track means 18*b* (but this situation is valid also for the first track means 18*a*) can be retained according to a variant during the passage also of the intermediate coils between the leading-end coils and trailing-end coils, that is to say when the flattening and overturning action of the track means 18*a* and 18*b* is not strictly necessary.

I claim:

1. Method to extract and deposit coils leaving a coiling machine, the coiling machine depositing the coils on a removal conveyor belt positioned on a substantially horizontal plane, the method comprising moving a coil-retaining assembly to a first working position in which the coil retaining assembly at least partly closes an outlet of the coiling machine for a period enough to permit the formation and accumulation of a desired number of leading-end coils within the coiling machine; then moving the coil retaining assembly to a second release position in which the coil retaining assembly frees the outlet of the coils from the coiling machine and enables the number of leading-end coils to fall simultaneously onto the removal conveyor belt, this simultaneous fall causing the flattening of the leading-end coils on the removal conveyor belt owing to the weight of that number of leading-end coils; and, while the coil retaining assembly is in the second release position, depositing each of a plurality of intermediate coils, the intermediate coils being formed subsequent to the leading-end coils and before trailing-end coils, from the coiling machine onto the removal conveyor belt as each coil is formed to arrange the intermediate coils on the removal conveyor belt such that the intermediate coils are partly superimposed on one another.

2. Method as in claim 1, further comprising, after depositing the intermediate coils on the removal conveyor belt, moving the coil-retaining assembly to the first working position to prevent emerging of the trailing-end coils from the coiling machine and to make possible the formation and accumulation of a desired number of trailing-end coils, and then moving the coil retaining assembly to the second release position in which it frees the outlet of the coils from the coiling machine and enables that number of trailing-end coils to fall simultaneously onto the removal conveyor belt, this simultaneous fall causing the flattening of the trailing-end coils on the removal conveyor belt owing to the weight of that number of trailing-end coils.

3. Method as in claim 2, in which the coil retaining assembly is kept in the first working position until the number of leading-end coils and/or trailing-end coils formed and accumulated in the coiling machine is between 3 and 15.

4. Method as in claim 1, further comprising moving a coil overturning and flattening assembly positioned downstream of the coiling machine to a first lowered working position from a second raised inactive position and pressing downwards and flattening at least the leading-end coils and/or trailing-end coils on the removal conveyor belt with the coil overturning and flattening assembly.

5. Method as in claim 4, further comprising moving the coil overturning and fattening assembly to the second raised inactive position at least during the passage of the intermediate coils between the leading-end coils and the trailing-end coils.

6. Method as in claim 1, wherein the coils leaving the coiling machine are coiled about an axis inclined with respect to the horizontal plane on which the removal conveyor belt is positioned.

* * * * *